US007578773B2

(12) United States Patent
Gronda et al.

(10) Patent No.: US 7,578,773 B2
(45) Date of Patent: Aug. 25, 2009

(54) EXERCISE DEVICE

(76) Inventors: Shanna Gronda, 8180 Manchester Blvd., Grosse Ile, MI (US) 48138; Kristi McCarty, 4038 Sherwood Forest, Toledo, OH (US) 43623

( * ) Notice: Subject to any disclaimer, the term of this patent is extended or adjusted under 35 U.S.C. 154(b) by 0 days.

(21) Appl. No.: 11/949,109

(22) Filed: Dec. 3, 2007

(65) Prior Publication Data

US 2009/0143204 A1 Jun. 4, 2009

(51) Int. Cl.
*A63B 21/008* (2006.01)
*A63B 21/02* (2006.01)

(52) U.S. Cl. ..... 482/111; 482/113; 482/124

(58) Field of Classification Search ..... 482/53, 482/58, 59, 73, 77, 11–113, 124, 126, 128; 124/65, 70; 267/118, 124; 446/176; *A63B 21/008*
See application file for complete search history.

(56) References Cited

U.S. PATENT DOCUMENTS 767,008 A 8/1904 Pelletier et al.
3,174,343 A * 3/1965 Kasulis ..... 482/112
3,465,592 A * 9/1969 Perrine ..... 482/5
3,471,145 A 10/1969 Berger
3,702,188 A * 11/1972 Bennet et al. ..... 482/113
3,834,696 A * 9/1974 Spector ..... 482/112
3,944,221 A * 3/1976 Berkestad et al. ..... 482/112
4,480,832 A * 11/1984 Bulmash et al. ..... 482/113
4,880,230 A 11/1989 Cook
5,529,559 A * 6/1996 Punzalan ..... 482/112
5,558,190 A 9/1996 Chang
5,913,756 A * 6/1999 Glaser ..... 482/128
6,468,190 B1 10/2002 Fazio et al.
D519,587 S * 4/2006 McCarty et al. ..... D21/692
7,163,495 B2 1/2007 Fazio et al.
7,267,641 B2 * 9/2007 Hsieh ..... 482/111
7,387,598 B2 * 6/2008 Miller ..... 482/112

* cited by examiner

*Primary Examiner*—Loan H Thanh
*Assistant Examiner*—Allana Lewin
(74) *Attorney, Agent, or Firm*—Dale J. Ream

(57) ABSTRACT

An exercise device includes first and second housings telescopically coupled together. A pneumatic cylinder is positioned inside and fixed to the first housing and includes proximal and distal ends. A piston having a piston head and shaft is situated inside the second housing, the piston head separating an interior space of the cylinder into first and second areas. Telescopic movement of the housings causes the piston head to move within the interior space. A first check valve is in fluid communication with the cylinder for adjusting an amount of resistance encountered by the piston head as it travels toward the cylinder distal end. A second check valve is in communication with the cylinder for adjusting an amount of resistance encountered as the piston head travels toward the cylinder proximal end. Pneumatic and check valve communication channels are inside the housing. The device is adaptable to exercise multiple muscle groups.

18 Claims, 9 Drawing Sheets

EXERCISE DEVICE

BACKGROUND OF THE INVENTION

The present invention relates generally to exercise devices and, more particularly, to a pneumatic exercise device that provides adjustable resistance training that result in beneficial exercise, toning, and development of a user's muscles.

The Pilates exercise methodology (hereinafter referred to as "Pilates") is a complete method of physical and mental conditioning developed by Joseph Pilates (1880-1967) that uses the principles of breath, awareness, concentration, centering, control, precision, and flowing movement to develop a user's body with an equal emphasis on strength and flexibility. The focus on well thought out and precise movements designed to align or re-align one's spine to its proper position by conditioning the deep postural muscles, such as the thighs, buttocks, and abdominals, has led to making Pilates one of the fastest growing forms of exercise in the world.

While Pilates is an exercise methodology apart from any particular apparatus, various devices have been proposed in the industry for assisting users in implementing the principles of Pilates. Although assumably effective for their intended purposes, the existing devices do not provide a device that is portable and storable for home use, that provides pneumatic resistance that is independently adjustable relative to a push or pull motion, or that is easily adaptable for exercising multiple muscle groups.

Therefore, it would be desirable to have an exercise device that provides resistance training to a user, that includes independent controls for varying the resistance for push and pulls strokes, respectively, and that may be used conveniently for exercising multiple muscle groups. Further, it would be desirable to have an exercise device in which individual check valves are easily accessible to a user at a single end of the device and that are interconnected by channels that are completely positioned within the interior of the device.

SUMMARY OF THE INVENTION

Accordingly, an exercise device according to the present invention includes first and second housings telescopically coupled together. A pneumatic cylinder is generally situated inside the first housing, the pneumatic cylinder having proximal and distal ends and being fixed relative to the first housing. A piston is positioned at least partially inside the second housing, the piston being fixed relative to the second housing and being configured to selectively travel inside the pneumatic cylinder. Accordingly, telescopic movement of the second housing relative to said first housing causes the piston to travel inside the pneumatic cylinder, the piston including a piston head and a piston shaft. The piston head is situated between the pneumatic cylinder distal and proximal ends and separates an interior space of the pneumatic cylinder into first and second isolated areas.

A first check valve is in fluid communication with the pneumatic cylinder distal end for adjusting an amount of resistance encountered by the piston head as the piston travels inside the pneumatic cylinder toward the pneumatic cylinder distal end. A second check valve is in fluid communication with the pneumatic cylinder proximal end for adjusting an amount of resistance encountered by the piston head as the piston travels inside the pneumatic cylinder toward the pneumatic cylinder proximal end, the first and second check valves being generally adjacent the pneumatic cylinder distal end.

The exercise device includes a first interface pad coupled to the first housing for interaction with a body part of a user, such as with an arm or leg. Similarly a second interface pad is coupled to the second housing for interaction with another body part, such as an opposing arm or leg. The device also includes adaptations such that it may be used between a person's thighs and chest, say, for crunches or sit-ups.

Therefore, a general object of this invention is to provide an exercise device that provides resistance training to a user.

Another object of this invention is to provide an exercise device, as aforesaid, that enables a user to selectively adjust an amount of resistance of an inward stroke of the exercise device that is different from a resistance of an outward stroke.

Yet another object of this invention is to provide an exercise device, as aforesaid, in which all pneumatic and valve elements are internal to the telescopic housings.

A further object of this invention is to provide an exercise device, as aforesaid, that is selectively adaptable for use in exercising multiple muscle groups.

A still further object of this invention is to provide an exercise device, as aforesaid, that is portable and storable.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An exercise device 100 according to the present invention will now be described in detail with reference to FIGS. 1*a* through 9*b* of the accompanying drawings. More particularly, according to the current invention, an exercise device 100 includes first and second housings 110, 120 telescopically coupled together.

Figure 3A:
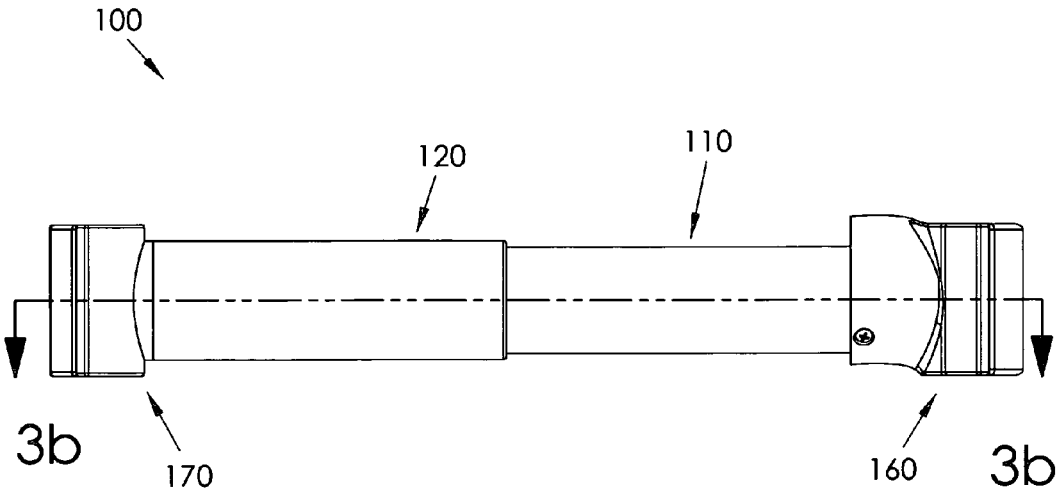
FIG. 3*a* is a bottom view of the exercise device as in FIG. 1.
Figure 3B:
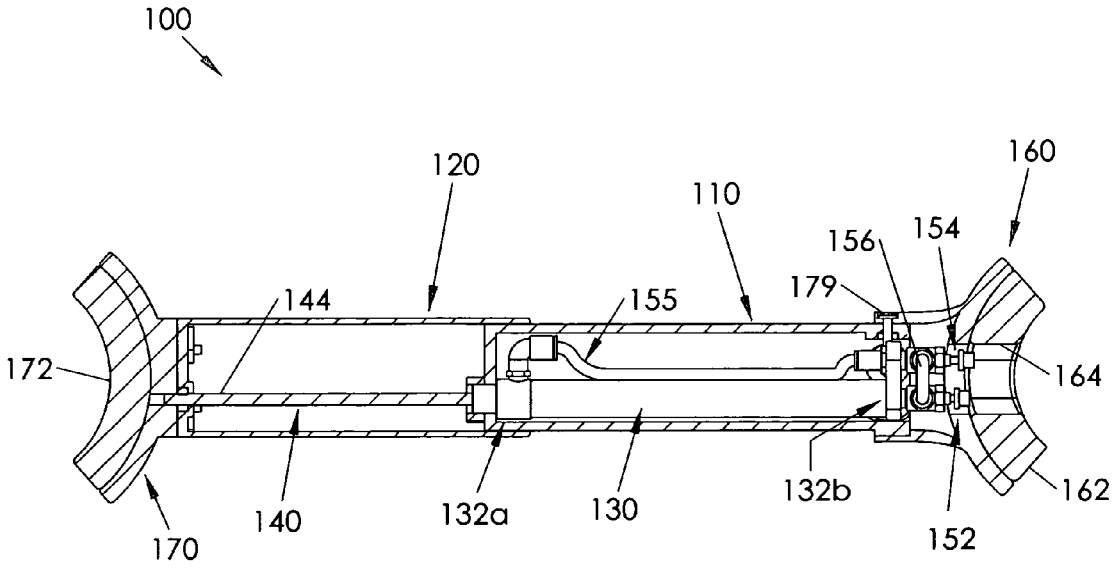
FIG. 3*b* is a sectional view taken along line 3*b*-3*b* of FIG. 3*a;*

As shown in FIG. 3*b*, a pneumatic cylinder 130 is generally situated inside the first housing 110. Though "pneumatic cylinder" is often used to refer to only air cylinders, "pneumatic cylinder" is used herein to refer to air cylinders and/or fluid (i.e., "hydraulic") cylinders. The pneumatic cylinder 130 has proximal and distal ends 132*a*, 132*b* (FIGS. 3*b*, 4, and 9*a*) and is fixed relative to the first housing 110.

Figure 9A:
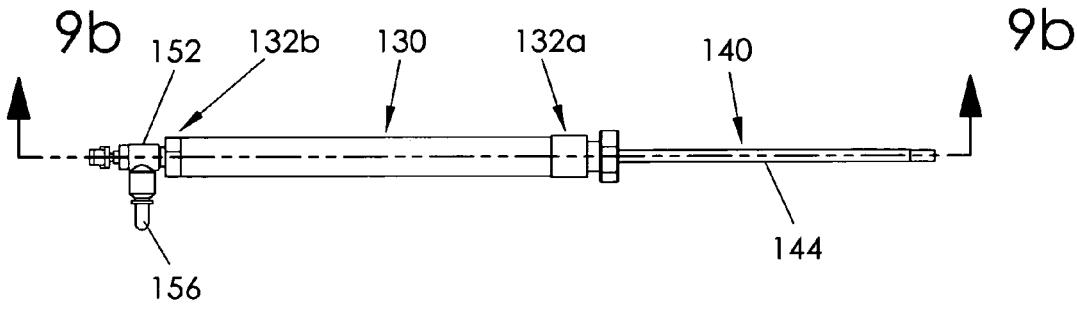
FIG. 9*a* is a top view of the exercise device as in FIG. 4.
Figure 9B:
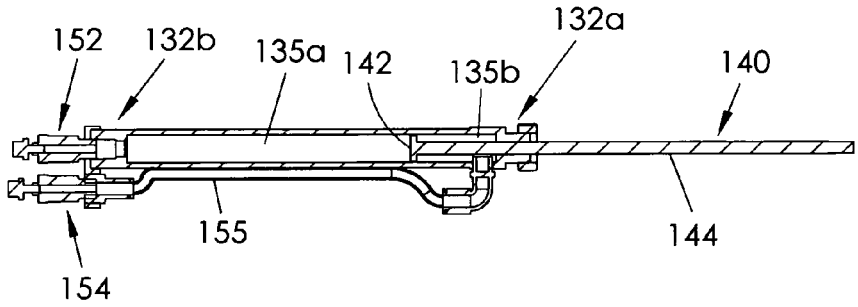
FIG. 9*b* is a sectional view taken along line 9*b*-9*b* of FIG. 9*a.*

A piston 140 is at least partially inside the second housing 120 (FIG. 3*b*) and includes a piston head 142 (FIG. 9*b*) and a piston shaft 144 (FIGS. 3*b* and 9*b*). As shown in FIG. 9*b*, the piston head 142 is between the pneumatic cylinder distal and proximal ends 132*a*, 132*b* to separate an interior space of the pneumatic cylinder 130 into first and second isolated areas 135*a*, 135*b*. The piston 140 is fixed relative to the second housing 120 and is configured to selectively travel inside the pneumatic cylinder 130 so that telescopic movement of the second housing 120 relative to the first housing 110 causes the piston 140 to travel inside the cylinder 130.

Figure 4:
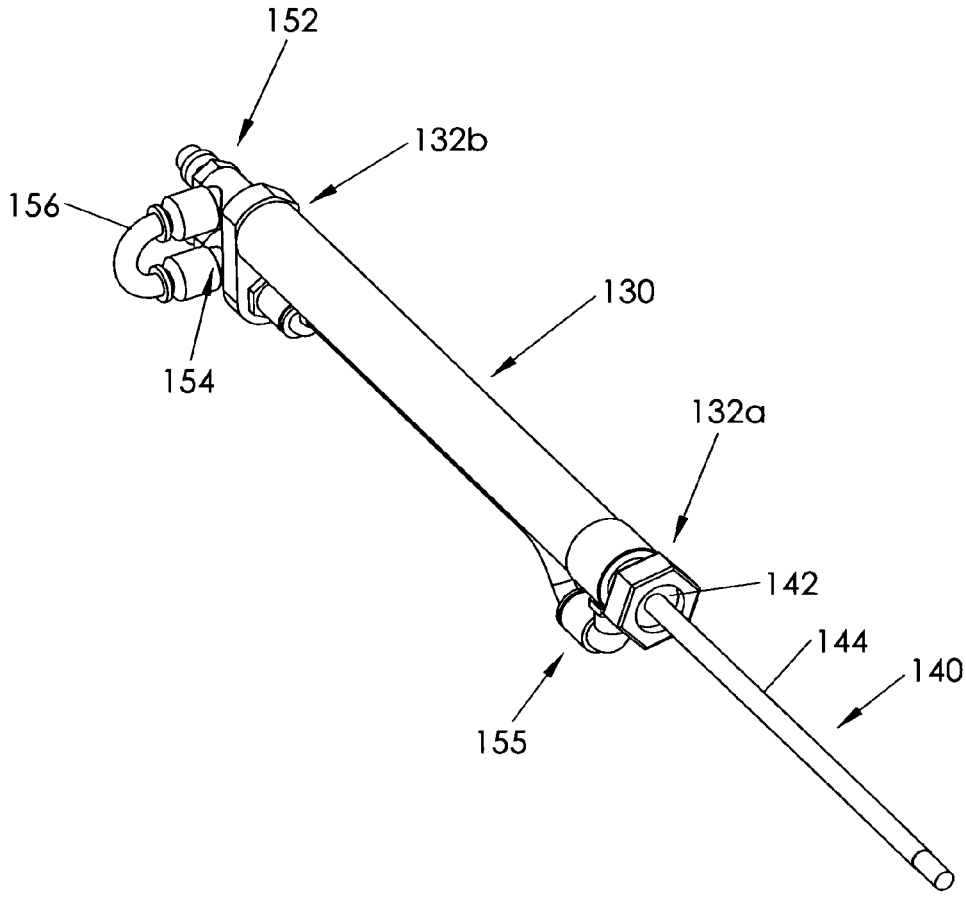
FIG. 4 is a perspective view of the piston, cylinder, and check valves removed from the first and second housings of the exercise device of FIG. 1.
Figure 5A:
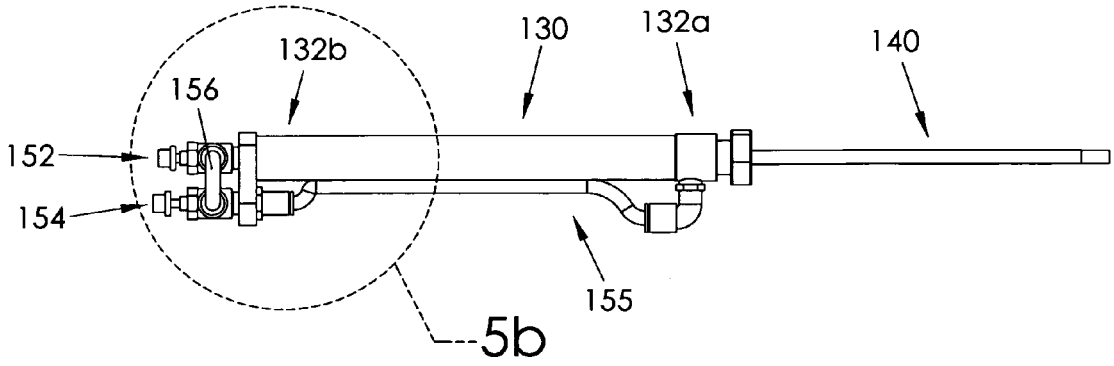
FIG. 5*a* is a side view of the piston, cylinder, and check valves as in FIG. 4.
Figure 5B:
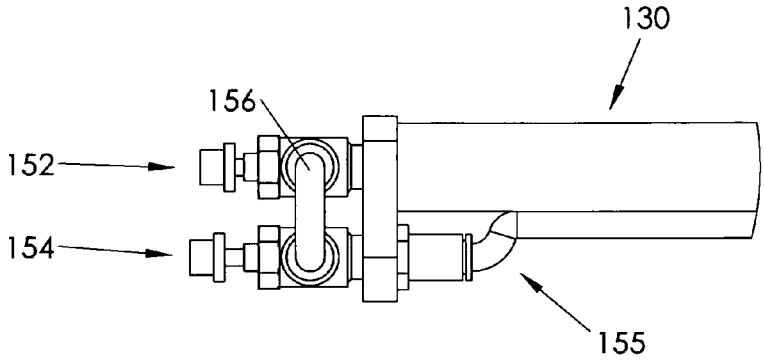
FIG. 5*b* is an isolated view of the check valves on an enlarged scale taken from a portion of FIG. 5*a;*
Figure 6:
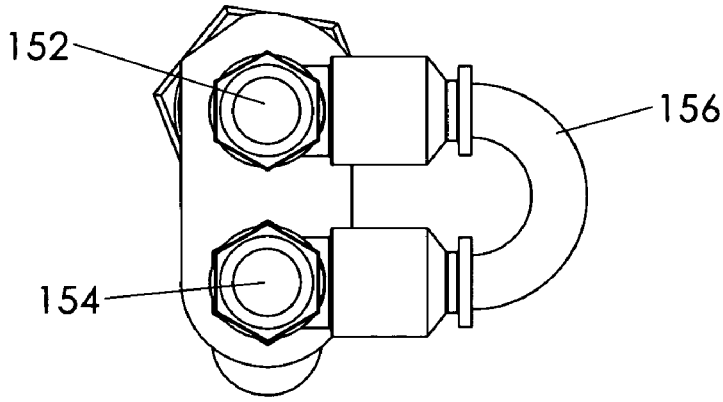
FIG. 6 is an end view of the check valves as in FIG. 5*b;*

As shown in FIGS. 5*a* and 5*b*, a first check valve 152 is in fluid communication with the pneumatic cylinder distal end 132*b* for adjusting an amount of resistance encountered by the piston head 142 as the piston 140 travels inside the pneumatic cylinder 130 toward the pneumatic cylinder distal end 132*b*. A second check valve 154 is in fluid communication with the pneumatic cylinder proximal end 132*a* for adjusting an amount of resistance encountered by the piston head 142 as the piston 140 travels inside the pneumatic cylinder 130 toward the pneumatic cylinder proximal end 132*a*. The first and second check valves 152, 154 may be generally adjacent one another, and in one embodiment, as shown in FIGS. 5*a* and 5*b*, the first and second check valves 152, 154 may be generally adjacent the pneumatic cylinder distal end 132*b*. More particularly, a conduit 155 may extend from the pneumatic cylinder proximal end 132*a* to the second check valve 154, which is adjacent the first check valve 152 (FIGS. 5*a* and 9*b*). As shown in FIG. 3*b*, the conduit 155 may be entirely inside the first housing 110. FIGS. 4 and 5*b* show that the first check valve 152 may be in fluid communication with the second check valve 154 (i.e., by connection 156) to create a closed fluid system extending from the pneumatic cylinder first isolated area 135*a* (FIG. 9*b*) to the first check valve 152 to the second check valve 154 to the pneumatic cylinder second isolated area 135*b* (FIG. 9*b*). A closed fluid system may be necessary for using fluid in the pneumatic cylinder 130.

Figure 1:
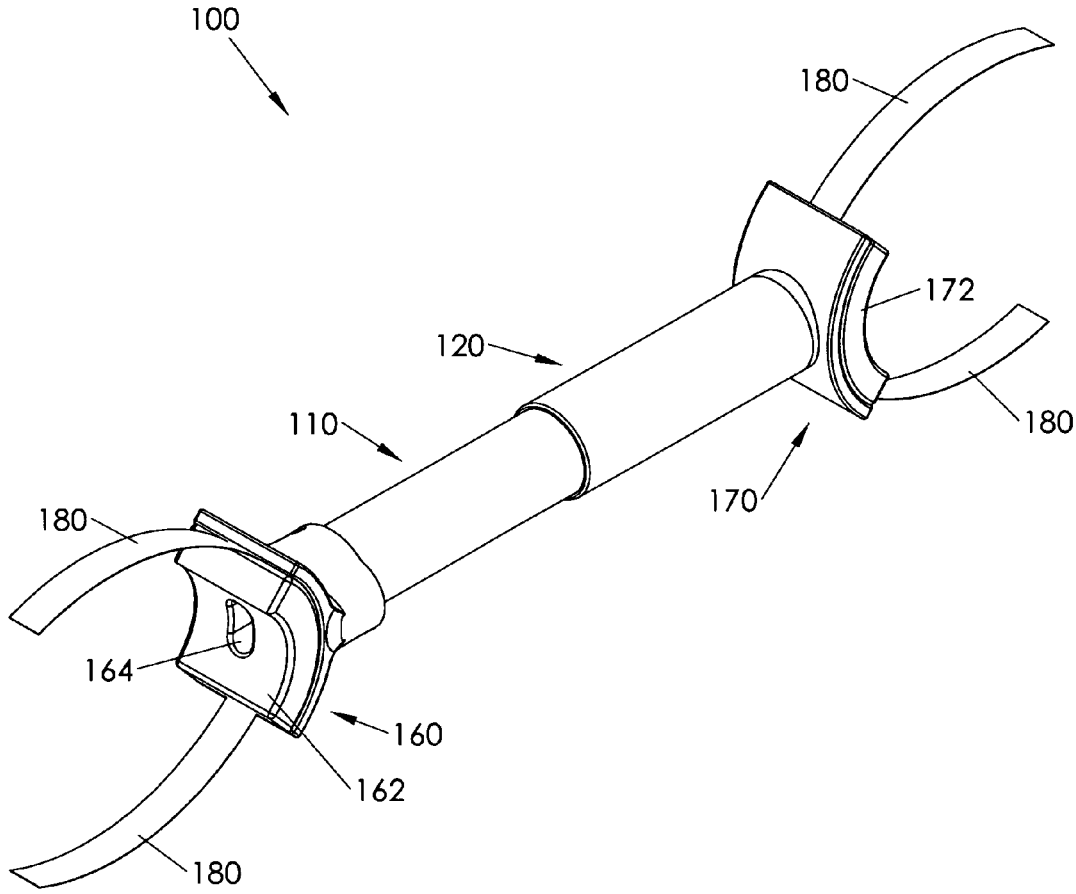
FIG. 1 is a perspective view of an exercise device according to an embodiment of the present invention.
Figure 7:
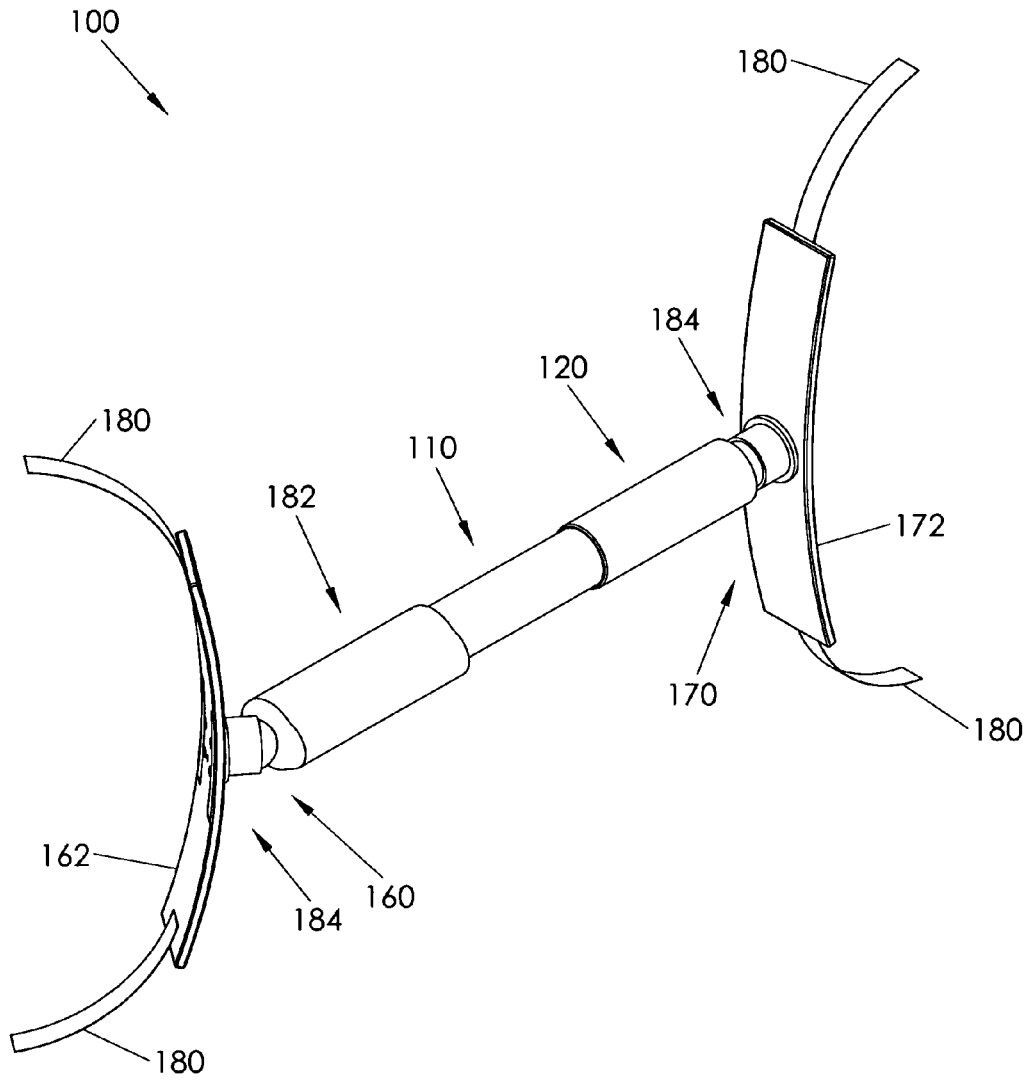
FIG. 7 is a perspective view of the exercise device as in FIG. 1 shown in use with an extension portion.

A first interface 160 is coupled to the first housing 110 for interaction with a body part, and a second interface 170 is coupled to the second housing 120 for interaction with another body part. The first and second interfaces 160, 170 may respectively include handles or pads 162, 172 for interacting with the respective body part. First and second interface pads 162, 172 may, for example, be generally arcuate and configured to respectively interact with an arm or leg (FIG. 1), or the first and second interface pads 162, 172 may be configured to respectively interact with a chest or thigh (FIG. 7). The first and second interfaces 160, 170 may be removably coupled to the first and second housings 110, 120 (e.g., by a removable fastener 179 as shown in FIG. 3*b*, complementary threads, etc.) to allow the user to utilize a variety of interface pads 162, 172 (such as those shown in FIGS. 1 and 7). As shown in FIGS. 1 and 3*b*, the first interface pad 162 may have a hole 164, and the first and second check valves 152, 154 may be accessible through the hole 164 for adjustment.

The first and second interfaces 160, 170 may respectively include means for attaching the first and second pads 162, 172 to the selected body parts. More particularly, straps 180 or other fasteners may be coupled to the pads 162, 172 to maintain the pads 162, 172 in contact with the selected body parts.

Figure 8A:
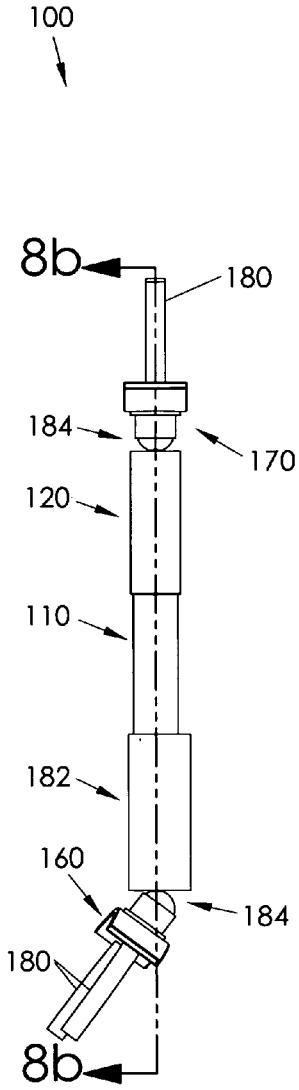
FIG. 8*a* is a top view of the exercise device as in FIG. 7.
Figure 8B:
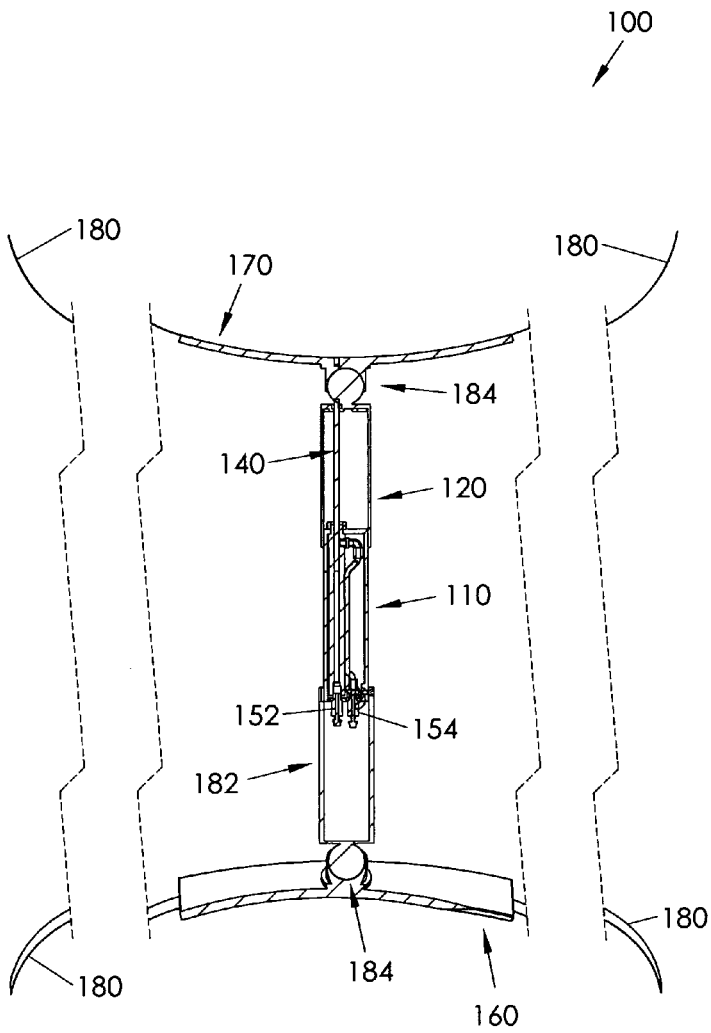
FIG. 8*b* is a sectional view taken along line 8*b*-8*b* of FIG. 8*a;*

Especially if the pads 162, 172 are configured to respectively interact with a chest or thigh, as described above and shown in FIGS. 7 through 8*b*, an extension portion 182 may be situated between the first housing 110 and the first interface pad 162 to effectively lengthen the first housing 110. Additionally, or alternately, a pivotal joint 184 may be between the first interface pad 162 and the first housing 110 and/or between the second interface pad 172 and the second housing 120 (FIG. 8*b*).

Figure 2A:
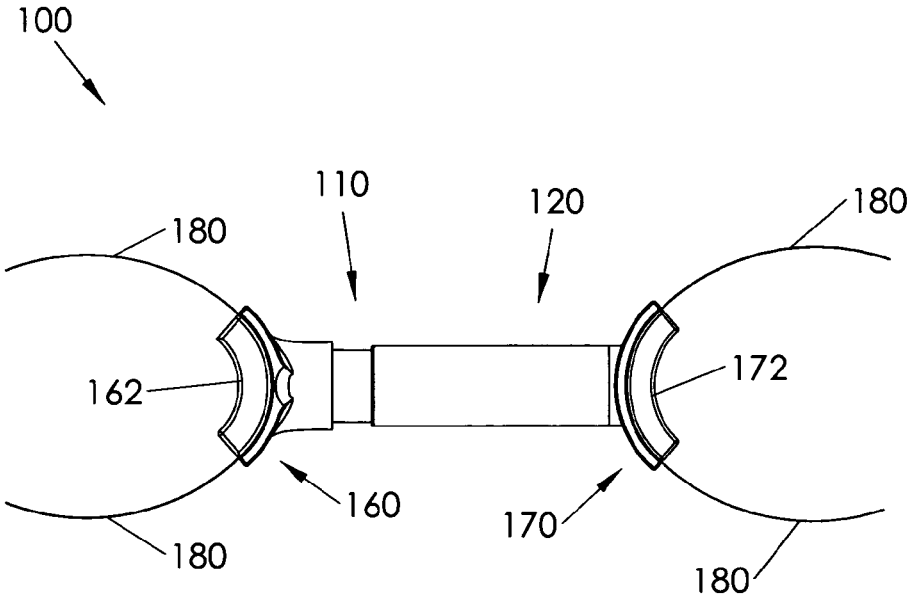
FIG. 2*a* is a side view of the exercise device as in FIG. 1 in an inward stroke configuration.
Figure 2B:
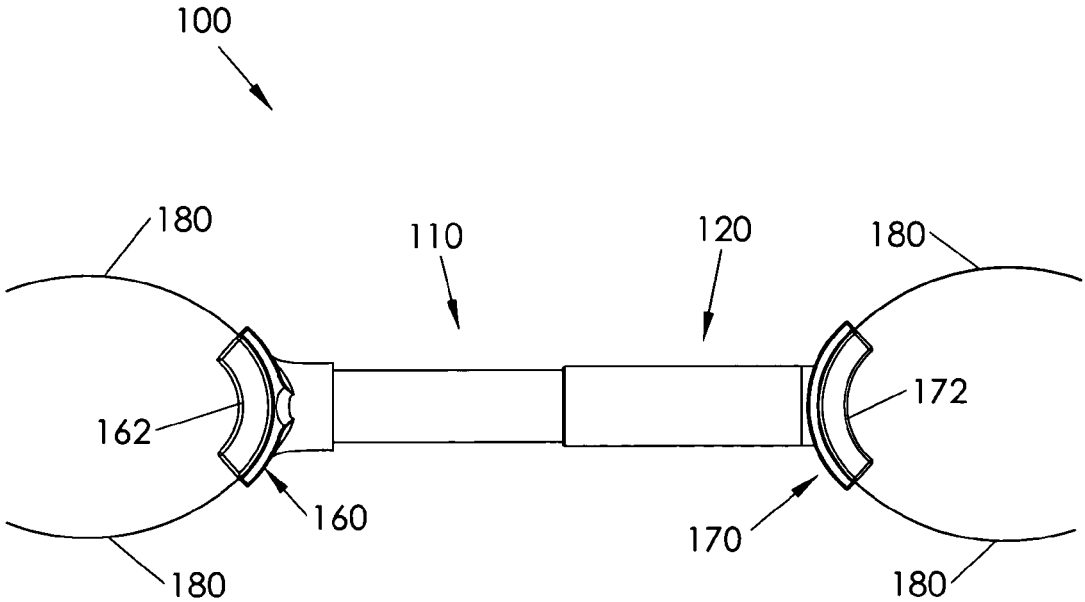
FIG. 2*b* is a side view of the exercise device as in FIG. 1 in an outward stroke configuration.

In use, the first and second check valves 152, 154 may be adjusted independently to set an amount of resistance that will be encountered when the first and second housings 110, 120 are moved telescopically inwardly (i.e., toward the configuration shown in FIG. 2*a*) and to set an amount of resistance that will be encountered when the first and second housings 110, 120 are moved telescopically outwardly (i.e., toward the configuration shown in FIG. 2*b*). By having the first and second check valves 152, 154 adjacent one another, the adjustment may be accomplished easily in a single location (such as through pad hole 164). If the interface pads 162, 172 are removable as described above, the desired pads 162, 172 may be coupled to the first and second housings 110, 120 to obtain a leg/arm configuration (FIG. 1) or a sit-up configuration (FIG. 7), for example.

When using the pads 162, 172 configured for the arms/legs (FIG. 1), the straps 180 may be attached to the appropriate body parts (i.e., opposing arms or opposing legs), and the user may move his arms or legs toward and away from one another. As the arms or legs move toward one another, the first and second housings 110, 120 are moved telescopically inwardly (i.e., toward the configuration shown in FIG. 2*a*) and the piston 140 travels inside the pneumatic cylinder 130 toward the pneumatic cylinder distal end 132*b*, forcing air or fluid out the first check valve 152. As the arms or legs move away from one another, the first and second housings 110, 120 are moved telescopically outwardly (i.e., toward the configuration shown in FIG. 2*b*) and the piston 140 travels inside the pneumatic cylinder 130 toward the pneumatic cylinder proximal end 132*a*, forcing air or fluid out the second check valve 154.

When using the pads 162, 172 configured for sit-ups (FIG. 7), the straps 180 may be attached to the appropriate body parts (i.e., the chest/torso and thighs), and the user may perform sit-ups or crunches. As the chest and thighs move toward one another, the first and second housings 110, 120 are moved telescopically inwardly and the piston 140 travels inside the pneumatic cylinder 130 toward the pneumatic cylinder distal end 132*b*, forcing air or fluid out the first check valve 152. As the chest and thighs move away from one another, the first and second housings 110, 120 are moved telescopically outwardly and the piston 140 travels inside the pneumatic cylinder 130 toward the pneumatic cylinder proximal end 132*a*, forcing air or fluid out the second check valve 154. The extension portion 182 and/or the pivotal joint(s) 184 may allow the pads 162, 172 to maintain in contact with the user as the chest and thighs are moved toward and away from one another.

It is understood that while certain forms of this invention have been illustrated and described, it is not limited thereto except insofar as such limitations are included in the following claims and allowable functional equivalents thereof.

The invention claimed is:

1. An exercise device, comprising:

first and second housings telescopically coupled together and defining a longitudinal axis of the device;

a pneumatic cylinder generally inside said first housing, said pneumatic cylinder having proximal and distal ends and being fixed relative to said first housing;

a piston at least partially inside said second housing, said piston being fixed relative to said second housing and being configured to selectively travel inside said pneumatic cylinder, wherein telescopic movement of said second housing relative to said first housing causes said piston to travel inside said pneumatic cylinder, wherein said piston includes a piston head and a piston shaft, said piston head being between said pneumatic cylinder distal and proximal ends and separating an interior space of said pneumatic cylinder into first and second isolated areas;

a first check valve in fluid communication with said pneumatic cylinder distal end for adjusting an amount of resistance encountered by said piston head as said piston travels inside said pneumatic cylinder toward said pneumatic cylinder distal end, said first check valve positioned adjacent said pneumatic cylinder distal end;

a second check valve in fluid communication with said pneumatic cylinder proximal end for adjusting an amount of resistance encountered by said piston head as said piston travels inside said pneumatic cylinder toward said pneumatic cylinder proximal end, said second check valve positioned adjacent said first check valve and said pneumatic cylinder distal end;

a first interface pad coupled to said first housing for interaction with a body part; and a second interface pad coupled to said second housing for interaction with another body part;

wherein said first and second check valves are positioned parallel to each other with respect to said longitudinal axis of the device;

wherein said first and second check valves are situated between said pneumatic cylinder distal end and said first interface pad;

wherein said first interface pad defines a hole through which said first and second check valves are accessible for adjustment.

2. The exercise device as in claim 1, further comprising a strap coupled to said first interface pad and a strap coupled to said second interface pad.

3. The exercise device as in claim 2, wherein said first interface pad is generally arcuate and said second interface pad is generally arcuate.

4. The exercise device as in claim 3, wherein:

said first interface pad is removably coupled to said first housing for interaction with at least one of an arm and a leg;

said second interface pad is removably coupled to said second housing for interaction with at least one of another arm and another leg;

a third interface pad is removably coupled to said first housing for interaction with at least one of a chest and a thigh;

a fourth interface pad is removably coupled to said second housing for interaction with at least another of a chest and a thigh;

said first interface pad is removably coupled to said first housing and said second interface pad is removably coupled to said second housing when said exercise device is at a first configuration;

said third interface pad is removably coupled to said first housing and said fourth interface pad is removably coupled to said second housing when said exercise device is at a second configuration.

5. The exercise device as in claim 1, wherein said first check valve is in fluid communication with said second check valve to create a closed fluid system from said pneumatic cylinder first isolated area to said first check valve to said second check valve to said pneumatic cylinder second isolated area.

6. The exercise device as in claim 1, wherein:

said first interface pad includes a hole; and said first and second check valves are accessible through said hole for adjustment.

7. The exercise device as in claim 1, wherein:

a conduit extends from said pneumatic cylinder proximal end to said second check valve; and said conduit is entirely inside said first housing.

8. The exercise device as in claim 1, further comprising:

a pivotal joint between said first interface pad and said first housing; and a pivotal joint between said second interface pad and said second housing.

9. The exercise device as in claim 8, further comprising:

an extension portion between said first housing and said first interface pad;

a strap coupled to said first interface pad; and a strap coupled to said second interface pad;

wherein said first interface pad is configured for interaction with at least one of a chest and a thigh; and wherein said second interface pad is configured for interaction with at least another of a chest and a thigh.

10. An exercise device, comprising:

first and second housings telescopically coupled together and defining a longitudinal axis of the device;

a pneumatic cylinder generally inside said first housing, said pneumatic cylinder having proximal and distal ends and being fixed relative to said first housing;

a piston at least partially inside said second housing, said piston being fixed relative to said second housing and being configured to selectively travel inside said pneumatic cylinder, wherein telescopic movement of said second housing relative to said first housing causes said piston to travel inside said pneumatic cylinder, wherein said piston includes a piston head and a piston shaft, said piston head being between said pneumatic cylinder distal and proximal ends;

a first check valve in fluid communication with said pneumatic cylinder distal end for adjusting an amount of resistance encountered by said piston head as said piston travels inside said pneumatic cylinder toward said pneumatic cylinder distal end;

a second check valve in fluid communication with said pneumatic cylinder proximal end for adjusting an amount of resistance encountered by said piston head as said piston travels inside said pneumatic cylinder toward said pneumatic cylinder proximal end, said second check valve being adjacent said first check valve and adjacent said pneumatic cylinder distal end;

a first interface pad coupled to said first housing for interaction with a body part; and a second interface pad coupled to said second housing for interaction with another body part;

wherein said first and second check valves are positioned parallel to each other with respect to said longitudinal axis the device;

wherein said first and second check valves are situated between said pneumatic cylinder distal end and said first interface pad; and wherein said first interface pad defines a hole through which said first and second check valves are accessible for adjustment.

11. The exercise device as in claim 10, wherein:

said first interface includes a strap and a generally arcuate pad having a hole; and said second interface includes a strap and a generally arcuate pad;

12. The exercise device as in claim 10, wherein:

a pivotal joint is between said first interface and said first housing; and a pivotal joint is between said second interface and said second housing.

13. The exercise device as in claim 12, further comprising an extension portion between said first housing and said first interface, and wherein:

said first interface pad is configured to interact with at least one of a chest and a thigh; and said second interface pad is configured to interact with at least another of a chest and a thigh.

14. The exercise device as in claim 13, wherein:

a conduit extends from said pneumatic cylinder proximal end to said second check valve; and said conduit is entirely inside said first housing.

15. An exercise device, comprising:

first and second housings telescopically coupled together and defining a longitudinal axis of the device;

a pneumatic cylinder generally inside said first housing, said pneumatic cylinder having proximal and distal ends and being fixed relative to said first housing;

a piston having a piston head and a piston shaft and being at least partially inside said second housing, said piston head being between said pneumatic cylinder distal and proximal ends, said piston being configured to selectively travel inside said pneumatic cylinder, wherein telescopic movement of said second housing relative to said first housing causes said piston to travel inside said pneumatic cylinder;

a first check valve in fluid communication with said pneumatic cylinder distal end for adjusting an amount of resistance encountered by said piston head as said piston travels inside said pneumatic cylinder toward said pneumatic cylinder distal end said first check valve being positioned adjacent said pneumatic cylinder distal end;

a second check valve in fluid communication with said pneumatic cylinder proximal end for adjusting an amount of resistance encountered by said piston head as said piston travels inside said pneumatic cylinder toward said pneumatic cylinder proximal end, said second check valve being generally adjacent said first check valve and said pneumatic cylinder distal end;

a first interface coupled to said first housing for interaction with a first body part, said first interface having a first pad and means for attaching said first pad to said first body part; and a second interface coupled to said second housing for interaction with a second body part, said second interface having a second pad and means for attaching said second pad to said second body part.

wherein said first and second check valves are positioned parallel to each other with respect to said longitudinal axis of the device;

wherein said first and second check valves are situated between said pneumatic cylinder distal end and said first interface pad; and wherein said first interface pad defines a hole through which said first and second check valves are accessible for adjustment.

16. The exercise device as in claim 15, wherein:

said means for attaching said first pad to said first body part includes a strap; and said means for attaching said second pad to said second body part includes a strap.

17. The exercise device as in claim 15, wherein:

a pivotal joint is between said first interface and said first housing;

a pivotal joint is between said second interface and said second housing;

an extension portion is between said first housing and said first interface;

said first pad is configured to interact with at least one of a chest and a thigh; and said second pad is configured to interact with at least another of a chest and a thigh.

18. The exercise device as in claim 15, wherein:

said first and second check valves are generally adjacent said pneumatic cylinder distal end;

a conduit extends from said pneumatic cylinder proximal end to said second check valve; and said conduit is entirely inside said first housing.

* * * * *